US009528691B2

(12) United States Patent
Markytan et al.

(10) Patent No.: US 9,528,691 B2
(45) Date of Patent: Dec. 27, 2016

(54) LIGHTING DEVICE

(75) Inventors: Ales Markytan, Regensburg (DE); Christian Gaertner, Regensburg (DE); Horst Varga, Lappersdorf (DE)

(73) Assignee: OSRAM Opto Semiconductors GmbH, Regensburg (DE)

( * ) Notice: Subject to any disclaimer, the term of this patent is extended or adjusted under 35 U.S.C. 154(b) by 514 days.

(21) Appl. No.: 14/115,614

(22) PCT Filed: May 11, 2012

(86) PCT No.: PCT/EP2012/058827

§ 371 (c)(1),
(2), (4) Date: Jan. 24, 2014

(87) PCT Pub. No.: WO2012/159906

PCT Pub. Date: Nov. 29, 2012

(65) Prior Publication Data

US 2014/0168964 A1 Jun. 19, 2014

(30) Foreign Application Priority Data

May 26, 2011 (DE) ..... 10 2011 102 567

(51) Int. Cl.
*F21V 23/00* (2015.01)
*F21V 23/04* (2006.01)
*F21Y 101/00* (2016.01)

(52) U.S. Cl.
CPC ..... *F21V 23/00* (2013.01); *F21K 9/60* (2016.08); *F21V 23/0457* (2013.01);
(Continued)

(58) Field of Classification Search
CPC .... F21V 23/00; F21V 23/003; F21V 23/0457; F21K 9/50; F21Y 2101/02; F21Y 2105/001; F21Y 2113/005
See application file for complete search history.

(56) References Cited

U.S. PATENT DOCUMENTS 7,731,389 B2 6/2010 Draganov et al.
2005/0161586 A1* 7/2005 Rains ..... F21S 2/00 250/214.1

(Continued)

FOREIGN PATENT DOCUMENTS

CN 101639164 A 2/2010
DE 60213804 T2 3/2007

(Continued)

*Primary Examiner* — Thomas M Sember
(74) *Attorney, Agent, or Firm* — Slater Matsil, LLP

(57) ABSTRACT

A lighting device has a carrier with a mounting face. A number of light-emitting diodes include at least two of the light-emitting diodes suitable for emitting light of different colors during operation. At least one color sensor, during operation, detects the light of at least one of the light-emitting diodes. At least one light-measuring face is illuminated by light of at least one of the light-emitting diodes and reflects and/or scatters at least a portion of this light. The light-emitting diodes and the at least one color sensor are arranged on the mounting surface, the at least one light-measuring face is arranged at a distance from the carrier, and the at least one color sensor; detects for the most part light reflected by the at least one light-measuring face from at least one of the multiplicity of light-emitting diodes.

20 Claims, 1 Drawing Sheet

(52) U.S. Cl.
CPC ..... *F21V 23/003* (2013.01); *F21Y 2101/00* (2013.01); *F21Y 2105/10* (2016.08); *F21Y 2113/13* (2016.08); *F21Y 2115/10* (2016.08)

(56) References Cited

U.S. PATENT DOCUMENTS

| | | | | |
|---|---|---|---|---|
| 2008/0093530 | A1 | 4/2008 | Hoelen et al. | |
| 2010/0118374 | A1 | 5/2010 | Quach | |
| 2010/0219760 | A1* | 9/2010 | Tanaka ..... | F21V 5/04 315/152 |

FOREIGN PATENT DOCUMENTS

| | | | |
|---|---|---|---|
| EP | 1988752 | A1 | 11/2008 |
| EP | 2216592 | A2 | 8/2010 |
| WO | 0223954 | A1 | 3/2002 |
| WO | 2006099732 | A1 | 9/2006 |
| WO | 2008023306 | A1 | 2/2008 |

* cited by examiner

LIGHTING DEVICE

This patent application is a national phase filing under section 371 of PCT/EP2012/058827, filed May 11, 2012, which claims the priority of German patent application 10 2011 102 567.0, filed May 26, 2011, each of which is incorporated herein by reference in its entirety.

TECHNICAL FIELD

Embodiments of the present invention relate to lighting devices.

BACKGROUND

European Patent Publication No. EP 2216592 A2 describes a lighting device.

SUMMARY OF THE INVENTION

Embodiments of the invention specify a lighting device which is suitable for emitting light of the same color over a long period of time.

In accordance with at least one embodiment of the lighting device, the lighting device comprises a carrier having a mounting area. The mounting area is arranged, for example, at a top side of the carrier. The mounting area is provided for accommodating components of the lighting device. The carrier is, for example, a connection carrier such as, for instance, a circuit board, a printed circuit board or metallic conductor strips, for example, a so-called leadframe. The carrier can be mechanically fixedly connected to a housing of the lighting device, for example. The carrier serves, in particular, for mechanically carrying and making electrical contact with components of the lighting device.

In accordance with at least one embodiment of the lighting device, the lighting device comprises a multiplicity of light-emitting diodes, wherein at least two of the light-emitting diodes are suitable for emitting light of mutually different colors during operation. In particular, the lighting device comprises at least two classes of light-emitting diodes which emit light of different colors. Each class can comprise at least two or more light-emitting diodes.

By way of example, the lighting device can comprise light-emitting diodes which emit greenish-white light (also mint) during operation and light-emitting diodes which emit red light during operation. The light from the multiplicity of light-emitting diodes can mix to form white light, for example, such that the lighting device is suitable during operation for emitting white mixed light. Furthermore, it is possible for the lighting device to comprise light-emitting diodes which emits red, blue, green and/or differently colored light.

In this case, the light-emitting diodes can be housed light-emitting diodes each comprising at least one light-emitting diode chip. However, it is also possible for the light-emitting diodes to be present as light-emitting diode chips which are arranged in a manner free of a housing in the lighting device.

In accordance with at least one embodiment of the lighting device, the lighting device comprises at least one color sensor which detects the light from at least one of the multiplicity of light-emitting diodes during operation. In this case, the at least one color sensor can be provided for emitting exclusively or substantially the light of a specific color. Furthermore, it is possible for the color sensor to be suitable for detecting the light from all the light-emitting diodes of the lighting device and thus light of different colors. The color sensor can comprise, for example, exactly one photodiode. A color filter can be disposed in front of the photodiode at its light entrance area, said color filter transmitting only light of a single color.

If the lighting device comprises, for example, n classes of light-emitting diodes which emit light of different colors in pairs, where n is a natural number ≥2, then the color sensor can comprise n photodiodes, a color filter being disposed in front of each photodiode, said color filter transmitting light of one of the colors that is generated by the light-emitting diodes of the lighting device. The lighting device then comprises a single color sensor.

Furthermore, it is possible for the lighting device to comprise n color sensors, wherein each color sensor detects light of one of the colors that is generated by the light-emitting diodes of the lighting device.

In other words, the color sensor or the color sensors can detect light of each color that is generated by the light-emitting diodes of the lighting device, such that a corresponding measurement value can be determined for each class of light-emitting diodes.

In accordance with at least one embodiment of the lighting device, the lighting device comprises at least one light-measuring area which is illuminated by the light from at least one of the multiplicity of light-emitting diodes and reflects and/or scatters at least part of said light. By way of example, the lighting device can comprise exactly one light-measuring area, which reflects and/or scatters the light of each color in equal parts. Furthermore, it is possible for the light-measuring area to be designed for reflecting or scattering exactly one of the colors that is generated by the light-emitting diodes. In this case, the lighting device preferably comprises a number of light-measuring areas corresponding to the number of classes of light-emitting diodes which emit light of different colors.

In accordance with at least one embodiment of the lighting device, the multiplicity of light-emitting diodes and the at least one color sensor are arranged on the mounting area of the carrier. That is to say that the light-emitting diodes and the color sensor are arranged in a common plane, for example. A light entrance area of the color sensor is then arranged, for example, at that surface of the color sensor which faces away from the carrier.

In accordance with at least one embodiment of the lighting device, the light-measuring area is arranged in a manner remote from the carrier. That is to say that the light-measuring area itself is not arranged on the carrier, but rather is arranged in a manner spaced apart from the carrier. By way of example, the light-measuring area is arranged at the side of the mounting area of the carrier in a manner spaced apart from the carrier.

In accordance with at least one embodiment of the lighting device, the at least one color sensor detects for the most part light from at least one of the multiplicity of light-emitting diodes that is reflected by the at least one light-measuring area. By way of example, the color sensor can detect mixed light, emitted by the light-measuring area, from all classes of light-emitting diodes which are present in the lighting device and which emit light of mutually different colors. Alternatively, it is possible for exactly one light-measuring area to be present for each color, to which light-measuring area exactly one color sensor can then be assigned, such that the color sensor detects light of a specific color that is reflected by the at least one light-measuring area.

In accordance with at least one embodiment of the lighting device, the lighting device comprises a carrier having a mounting area, a multiplicity of light-emitting diodes, wherein at least two of the light-emitting diodes are suitable for emitting light of mutually different colors during operation, at least one color sensor which detects the light from at least one of the multiplicity of light-emitting diodes during operation, and at least one light-measuring area which is illuminated by the light from at least one of the multiplicity of light-emitting diodes and reflects and/or scatters at least part of said light. In this case, the multiplicity of light-emitting diodes and the at least one color sensor are arranged on the mounting area of the carrier, the at least one light-measuring area is arranged in a manner remote from the carrier, and the at least one color sensor detects for the most part light from at least one of the multiplicity of light-emitting diodes that is reflected by the at least one light-measuring area.

In the case of the lighting device described here, it is possible, with the aid of the color sensor, to determine measurement values for the intensity of the light from the light-emitting diodes of the lighting device, wherein measurement values can be determined in particular for different colors of the light. The measurement values can be used to regulate the light-emitting diodes of the lighting device, such that the lighting device emits mixed light of a specific color and/or of a specific color locus in a manner as constant as possible. In this way, for example, a different ageing behavior and/or a different temperature dependence of light-emitting diodes of different classes, that is to say of different designs, can be compensated for. It is thus possible to generate light having over time particularly constant light color and/or particularly constant color temperature.

In accordance with at least one embodiment of the lighting device, the at least one color sensor has a reception range having an aperture angle and exactly one light-measuring area is arranged in the reception range of each color sensor. The aperture angle of the color sensor is preferably chosen to be small in this case. By way of example, the aperture angle is <7°, preferably <5°. By way of example, a conical reception range is predefined by the aperture angle. Only light from this reception range impinges on a light entrance area of the color sensor. If exactly one light-measuring area is then arranged in the reception range of an assigned color sensor, it is ensured that the color sensor substantially only detects light that is reflected or scattered by said light-measuring area. Depending on whether the light-measuring area is designed to emit white mixed light or whether the light measuring area is designed to emit light of a specific color, the assigned color sensor is designed to detect light of different colors or light of a specific color.

In accordance with at least one embodiment of the lighting device, each of the at least one light-measuring area is illuminated by the light from a plurality of the multiplicity of light-emitting diodes. That is to say that, via the light-measuring area, it is possible to effect averaging, for example, over a plurality of light-emitting diodes of identical type, such that the color sensor can then detect light which, in terms of its intensity, corresponds to an average value of the light-emitting diodes which illuminate the light-measuring area. Preferably, the light-measuring area is arranged in such a way that at least all light-emitting diodes of the same color in the lighting device can illuminate the light-measuring area. In this way, for each color of the light generated by the light-emitting diodes during operation, a particularly precise value can be determined by the color sensor.

In accordance with at least one embodiment of the lighting device, each of the at least one light-measuring area is shielded from ambient light, such that for the most part or exclusively light generated by the multiplicity of light-emitting diodes impinges on the light-measuring area. By way of example, a layer that is not transmissive to radiation is applied at a side of the light-measuring area which faces away from the light-emitting diodes, such that light from the light-emitting diodes, and not, for example, from outside the lighting device, can impinge on the light-measuring area. Furthermore, it is possible for the light-measuring area to be formed with a bulk-scattering material embodied with haze and thickness such that light penetrating from outside the lighting device cannot penetrate through the material as far as that surface of the material which faces the light-emitting diodes. This surface then forms the light-emitting light-measuring area.

From outside the lighting device, that side of the light-measuring area which faces away from the light-emitting diodes appears white, for example. For this purpose, this side can be embodied as diffusely white scattering. If the lighting device generates white mixed light during operation, then the light-measuring area cannot be discerned or can hardly be discerned with the naked eye from outside the lighting device.

In accordance with at least one embodiment of the lighting device, each of the at least one light-measuring area is arranged at a cover plate of the lighting device, wherein the cover plate is arranged at the side of the mounting area in a manner spaced apart from the carrier. The cover plate is embodied as radiation-transmissive, such that the light generated by the light-emitting diodes during operation can penetrate through the cover plate toward the outside. In this case, it is possible for the cover plate to have light-scattering or light-mixing properties. For this purpose, the cover plate can have a correspondingly structured outer area or be embodied as bulk-scattering. In any case, the cover plate preferably has a lower haze than each of the light-measuring areas of the lighting device. The use of light-measuring areas at the cover plate makes it possible to choose the cover plate particularly freely with regard to its optical properties, since the cover plate does not have to fulfill the task of reflecting or scattering light generated by the light-emitting diodes during operation to the color sensor. This task is fulfilled by the light-measuring area.

In accordance with at least one embodiment, the cover plate has a haze value of at most 0.10, preferably of at most 0.05, in particular in a direction perpendicular to at least one of the main sides of the cover plate. The haze value is also designated as haziness. The haze value is defined, for example, for transmission, as the quotient of that proportion of a radiation which is scattered by an angle of more than 2.5° upon passing through a medium and of the total radiation transmitted by the medium. In other words, the cover plate is then transparent or virtually transparent. The light-measuring area has, for example, a higher haze value of greater than 0.15.

In accordance with at least one embodiment of the lighting device, each of the at least one light-measuring area is formed with a diffusely reflective or diffusely scattering material which is arranged at that side of the cover plate which faces the multiplicity of light-emitting diodes. By way of example, the material can be adhesively bonded onto that side of the cover plate which faces the light-emitting diodes. By way of example, the material is a body composed of white ceramic material or a body comprising a matrix material such as silicone or epoxide, into which light-scattering particles composed, for example, of titanium dioxide are introduced. By means of the choice of the material of the light-measuring area, it is then possible to set whether the light-measuring area emits white light or whether the emission from the light-measuring area is optimized to the emission of light of a specific color. In particular, light-scattering particles which contain at least one of the following materials are appropriate: $TiO_2$, $BaSO_4$, ZnO, $Al_xO_y$, $ZrO_2$.

In accordance with at least one embodiment of the lighting device, the area content of each of the at least one light-measuring area is at most double the magnitude of the area of the projection of the reception range of a color sensor assigned to the light-measuring area onto the cover plate. The area content and the form of the light-measuring area correspond as far as possible to the projection of the reception range of the assigned light sensor onto the cover plate. In this way, it is ensured that the light-measuring area takes up the smallest possible space on the cover plate, such that a largest possible proportion of the cover plate is available for the emergence of light. By way of example, the sum of the area contents of all the light-measuring areas of the lighting device is at most 10%, in particular at most 5%, preferably at most 1%, of the area content of the cover plate.

In accordance with at least one embodiment of the lighting device, the lighting device comprises at least two light-measuring areas, wherein a first of the light-measuring areas reflects or scatters light of a specific color to a greater extent than another of the two light-measuring areas. For example, for this purpose the light-measuring areas can be embodied as Bragg reflectors or dielectric mirrors which are set for reflecting light of a specific color. Furthermore, it is possible for the light-measuring areas to comprise scattering particles that scatter light of a specific color to a particularly great extent. Overall, it is possible in this case for light-measuring areas of the lighting device to differ from one another with regard to their scattering effect or reflection of light of a specific color.

In accordance with at least one embodiment of the lighting device, at least one of the light-measuring areas reflects or scatters light of one color to a greater extent than light of another color and a color sensor assigned to the light-measuring area has a higher sensitivity to the more greatly reflected or more greatly scattered light than to the light of the other color. That is to say that light-measuring area and color sensor can be coordinated with one another, such that even before light impinges on the light entrance area of the color sensor, the light of the different colors can be split by means of the light-measuring area.

In accordance with at least one embodiment of the lighting device, the lighting device comprises a drive apparatus, which is designed to regulate the multiplicity of light-emitting diodes in a manner dependent on measurement signals of the at least one color sensor. That is to say that, depending on the measurement signals, it possible to vary, for example, a clock frequency with which the light-emitting diodes are driven, or an operating current with which the light-emitting diodes are operated. For this purpose, the drive apparatus can comprise, for example, at least one microprocessor, at least one driver and at least one pulse width modulation circuit.

If, by way of example, it is ascertained on the basis of the measurement values that the intensity of the light from a first class of light-emitting diodes decreases to a greater extent than the intensity of the light from a second class of light-emitting diodes of the lighting device, then a corresponding readjustment can be effected in order to emit mixed light having a constant color locus and/or constant color temperature from the lighting device.

That is to say that, in accordance with at least one lighting device, the drive apparatus is designed to set and keep substantially constant a color locus and/or a color temperature of the mixed light from the multiplicity of light-emitting diodes that is emitted by the lighting device. In this case, "substantially constant" means that the color locus and/or the color temperature fluctuate(s) over a relatively long period of time, for example, at least over one hour, at most by ±5%, in particular at most by ±2.5%, around an average value of the color locus and/or of the color temperature.

Furthermore, a setting of color locus and/or color temperature can be effected by means of the drive apparatus. That is to say that the drive apparatus can also be designed to implement changes to the color locus and/or color temperature that are predefined externally, for example, by a user, by corresponding driving of the light-emitting diodes.

BRIEF DESCRIPTION OF THE DRAWINGS

A lighting device described here is explained in greater detail below on the basis of exemplary embodiments and the associated figures.

In conjunction with FIGS. 1A and 1B, an exemplary embodiment of a lighting device described here is explained in greater detail with reference to schematic sectional illustrations.

Elements that are identical, of identical type or act identically are provided with the same reference signs in the figures. The figures and the size relationships of the elements illustrated in the figures among one another should not be regarded as to scale. Rather, individual elements may be illustrated with an exaggerated size in order to enable better illustration and/or in order to afford a better understanding.

DETAILED DESCRIPTION OF ILLUSTRATIVE EMBODIMENTS

Figure 1A:
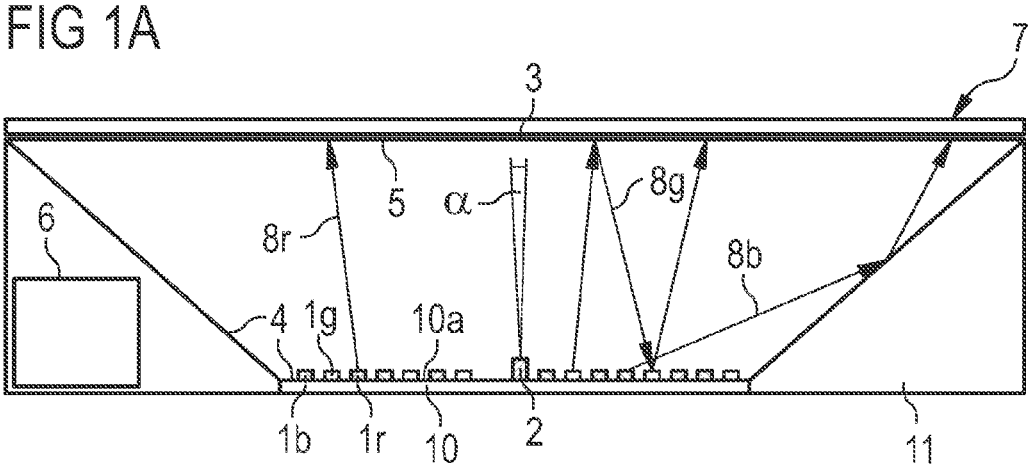
Figure 1B:
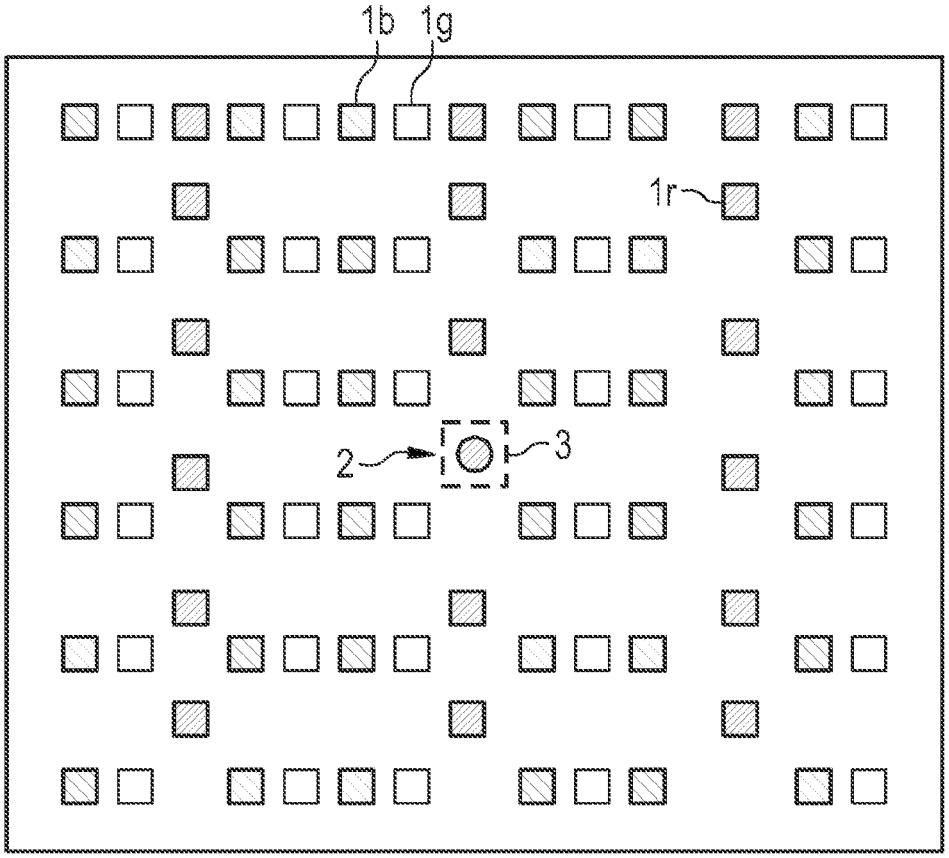

FIG. 1A shows a schematic sectional illustration of the lighting device, and FIG. 1B shows a schematic plan view. The lighting device comprises in the present case three classes of light-emitting diodes, which are arranged as light-emitting diode chips on the mounting area 10*a* of the carrier 10 of the lighting device. The carrier 10 in the present case is a connection carrier, for example, a circuit board.

The lighting device comprises in the present case light-emitting diodes 1*b* which emit blue light, light-emitting diodes 1*g* which emit green light and light-emitting diodes 1*r* which emit red light. The light-emitting diodes 1*b*, 1*g*, 1*r* emit the light 8*g*, 8*b*, 8*r* generated during operation in the direction of a radiation-transmissive cover plate 5 of the lighting device. Part of the light can be reflected at reflective surfaces 4 of a housing body 11 and/or of the carrier 10. By way of example, the reflective surface 4 of the housing body 11 is embodied as obliquely inclined in places in the manner of a reflector.

The lighting device furthermore comprises a color sensor 2, which in the present case is designed to detect blue, green and red light. That is to say, that the color sensor 2 generates, in accordance with the intensity of the light of the individual colors, measurement values which are, for example, proportional to the intensity of the light of a color. In this case, the color sensor 2 generates measurement values for red, green and blue light separately.

The color sensor 2 has a reception range having an aperture range cc, which in the present case is 5°. The aperture angle cc is chosen such that a light-measuring area 3 situated opposite the color sensor 2 corresponds, in terms of its extent at the cover plate 5, to the projection of the reception range onto the cover plate 5. That is to say that the color sensor 2 detects substantially light which is reflected and/or scattered by the light-measuring area 3 and which is composed of the light from many of the light-emitting diodes of the lighting device.

In the present case, the light-measuring area 3 is formed with a bulk-scattering material that is suitable for effecting diffusely white scattering of light. In this case, the scattering body is embodied with a thickness such that light from outside the lighting device does not penetrate as far as the outer area facing the light-emitting diodes, that is to say the actual light-measuring area.

The measurement values determined by the color sensor 2 are conducted, for example, via conductor tracks at the carrier 10 to a drive apparatus 6, which processes the measurement values and correspondingly drives and/or regulates the light-emitting diodes. In this case, the drive apparatus can be integrated into the housing body 11 of the lighting device, which makes possible a particularly compact component.

An optical element 7 can furthermore be arranged at that side of the cover plate 5 which faces away from the carrier 10, said optical element being suitable, for example, for beam shaping or light scattering of the light emerging from the lighting device.

Overall, a lighting device described here is distinguished, in particular, by the following advantages. The light-measuring area 3 can detect the light from a plurality of light-emitting diodes 1*b*, 1*r*, 1*g* even of different classes, thus resulting in a reduction of the statistical straggling when determining, for example, the intensity for the light of a specific color.

The light-measuring area 3 is not influenced, or is hardly influenced, by external light such as daylight, for example. The light-measuring area 3 takes up only a very small part of the cover plate 5, for example at most 1% of the cover plate 5, which results in an increased luminous efficiency since the cover plate 5 itself need not be embodied as highly scattering over a large area. That is to say that the cover plate 5 can be embodied, in particular, with lower haze than the light-measuring area 3.

Additional degrees of freedom in configuration additionally arise with regard to the design of the optical properties of the cover plate 5 independently of the color sensor 2.

The invention is not restricted to the exemplary embodiments by the description on the basis of said exemplary embodiments. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. A lighting device comprising:

a carrier having a mounting area;

a plurality of light-emitting diodes, wherein at least two of the light-emitting diodes are suitable for emitting light of mutually different colors during operation;

a color sensor configured to detect the light from at least one of the light-emitting diodes during operation; and a light-measuring area that is to be illuminated by the light from at least one of the light-emitting diodes and is configured to reflect and/or scatter at least part of the light, wherein the light-emitting diodes and the color sensor are arranged on the mounting area, wherein the light-measuring area is arranged remote from the carrier, wherein the color sensor is configured to detect mostly the light from at least one of the light-emitting diodes that is reflected and/or scattered by the light-measuring area, wherein the light-measuring area is arranged at a cover plate of the lighting device, wherein the cover plate is arranged at a side of the mounting area in a manner spaced apart from the carrier, wherein the cover plate is light-transmissive and has a lower haze than the light-measuring area, and wherein the light-measuring area is formed with a diffusely reflective or diffusely scattering material, which is arranged at a side of the cover plate that faces the plurality of light-emitting diodes.

2. The lighting device according to claim 1, comprising two light-measuring areas, wherein a first of the two light-measuring areas reflects or scatters light of a specific color to a greater extent than a second of the two light-measuring areas.

3. The lighting device according to claim 1, wherein the color sensor has a reception range having an aperture angle and wherein exactly one light-measuring area is arranged in the reception range of the color sensor.

4. The lighting device according to claim 1, wherein the light-measuring area is illuminated by the light from a plurality of the light-emitting diodes.

5. The lighting device according to claim 1, wherein the light-measuring area is shielded from ambient light, such that most or all light that impinges on the light-measuring area has been generated by the light-emitting diodes.

6. The lighting device according to claim 1, wherein the light-measuring area is arranged at a cover plate of the lighting device, wherein the cover plate is arranged at a side of the mounting area in a manner spaced apart from the carrier.

7. The lighting device according to claim 6, wherein the cover plate is light-transmissive and has a lower haze than each of the light-measuring area.

8. The lighting device according to claim 7, wherein the light-measuring area is formed with a diffusely reflective or diffusely scattering material, that is arranged at that side of the cover plate which faces the plurality of light-emitting diodes.

9. The lighting device according to claim 6, wherein a sum of areas of all light-measuring areas is at most 10% of the area of the cover plate.

10. The lighting device according to claim 1, wherein the lighting device comprises a plurality of color sensors;

wherein each color sensor has a reception range having an aperture angle;

wherein the lighting device comprises a plurality of light measuring areas;

wherein exactly one light-measuring area is arranged in the reception range of each color sensor; and wherein an area of each light-measuring area is at most double a magnitude of an area of a projection of the reception range of the color sensor assigned to the light-measuring area.

11. The lighting device according to claim 1, wherein the light-measuring area reflects or scatters light of one color to a greater extent than light of another color and wherein the color sensor is assigned to the light-measuring area and has a higher sensitivity to the more greatly reflected or more greatly scattered light than to the light of the other color.

12. The lighting device according to claim 1, further comprising a drive apparatus configured to regulate the plurality of light-emitting diodes in a manner dependent on measurement signals of the color sensor.

13. The lighting device according to claim 12, wherein the drive apparatus is configured to set and keep substantially constant a color locus and/or a color temperature of mixed light from the light-emitting diodes that is emitted by the lighting device.

14. A lighting device comprising:

a carrier having a mounting area;

a plurality of light-emitting diodes, wherein at least two of the light-emitting diodes are suitable for emitting light of mutually different colors during operation;

a plurality of color sensors configured to detect the light from at least one of the light-emitting diodes during operation;

a plurality of light-measuring areas that are to be illuminated by the light from at least one of the light-emitting diodes and configured to reflect and/or scatter at least part of the light;

wherein the light-emitting diodes and the color sensors are arranged on the mounting area;

wherein the light-measuring areas are arranged in a manner remote from the carrier; and wherein the color sensors are configured to detect for mostly light from at least one of the light-emitting diodes that is reflected and/or scattered by the light-measuring areas.

15. The lighting device according to claim 14, wherein the light-measuring areas are arranged at a cover plate of the lighting device, wherein the cover plate is arranged at a side of the mounting area spaced apart from the carrier;

wherein the cover plate is light-transmissive and has a lower haze than the light-measuring area; and wherein the light-measuring areas are formed with a diffusely reflective or diffusely scattering material, which is arranged at a side of the cover plate that faces the plurality of light-emitting diodes.

16. The lighting device according to claim 15, wherein each color sensor has a reception range having an aperture angle, and wherein exactly one light-measuring area is arranged in the reception range of each color sensor.

17. The lighting device according to claim 16, wherein the light-measuring areas are illuminated by the light from a plurality of the light-emitting diodes.

18. The lighting device according to claim 16, wherein an area of each light-measuring area is at most double the magnitude of the area of a projection of the reception range of a color sensor assigned to the light-measuring area onto the cover plate.

19. The lighting device according to claim 16, wherein a sum of the areas of all the light-measuring areas is at most 10% of the area of the cover plate.

20. A lighting device comprising:

a carrier having a mounting area;

a plurality of light-emitting diodes, wherein at least two of the light-emitting diodes are suitable for emitting light of mutually different colors during operation;

a color sensor configured to detect the light from at least one of the light-emitting diodes during operation;

a light-measuring area that is to be illuminated by the light from at least one of the light-emitting diodes and is configured to reflect and/or scatter at least part of the light;

wherein the light-emitting diodes and the color sensor are arranged on the mounting area;

wherein the light-measuring area is arranged remote from the carrier;

wherein the color sensor is configured to detect mostly the light from at least one of the light-emitting diodes that is reflected and/or scattered by the light-measuring area;

wherein the light-measuring area reflects or scatters light of one color to a greater extent than light of another color; and wherein the color sensor is assigned to the light-measuring area and has a higher sensitivity to the more greatly reflected or more greatly scattered light than to the light of the other color.

* * * * *